United States Patent [19]

Kamphausen

[11] 4,196,533

[45] Apr. 8, 1980

[54] PLANT MARKER

[75] Inventor: Dan Kamphausen, Littleton, Colo.

[73] Assignee: Happy Harvest Inc., Englewood, Colo.

[21] Appl. No.: 846,587

[22] Filed: Oct. 28, 1977

[51] Int. Cl.[2] ..... G09F 3/00

[52] U.S. Cl. ..... 40/10 C; 47/47

[58] Field of Search ..... 40/10 C, 606; 47/47

[56] References Cited

U.S. PATENT DOCUMENTS

| | | | |
|---|---|---|---|
| 2,153,229 | 4/1939 | Arkin | 40/10 C |
| 2,292,272 | 8/1942 | Hirshfield | 40/10 C |
| 2,662,321 | 12/1953 | Stoffel | 40/10 C |
| 2,807,897 | 10/1957 | Reynolds | 40/10 C |
| 4,027,410 | 6/1977 | Wheeler | 40/10 C |
| 4,079,530 | 3/1978 | Atherton et al. | 40/10 C |

*Primary Examiner*—John F. Pitrelli
*Assistant Examiner*—G. Lee Skillington
*Attorney, Agent, or Firm*—Christel, Bean & Linihan

[57] ABSTRACT

A plant or garden marker comprising a stake element preferably of plastic material having a stem or shank portion with a sharp point at one end thereof and an enlarged planar mounting surface at the opposite end thereof. An identification member such as a decal is removably applied to the mounting surface and serves to identify plants by means of graphic information or indicia or both. The identification member also can be a sheet element provided with pressure sensitive adhesive. The mounting surface is outlined by a rib-like formation which outlines the location of the identification member. Various identification members can be purchased separately according to different varieties of plants the user intends to grow, and a selected member is affixed to a stake element which then is driven by hand into the ground adjacent the plant or plants to be identified. The same stake element can be used with different identification members simply by removing an old one and replacing it with a new member. The shank portion is reinforced by a pair of rib-like elements extending therealong of generally U-shaped cross section.

10 Claims, 6 Drawing Figures

Fig. 1.
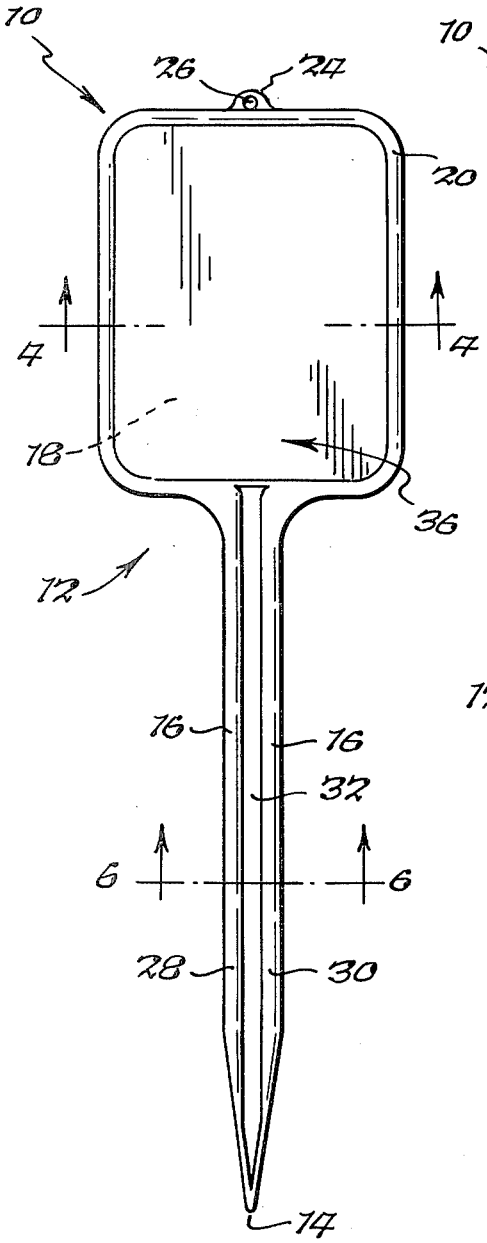
Fig. 2.
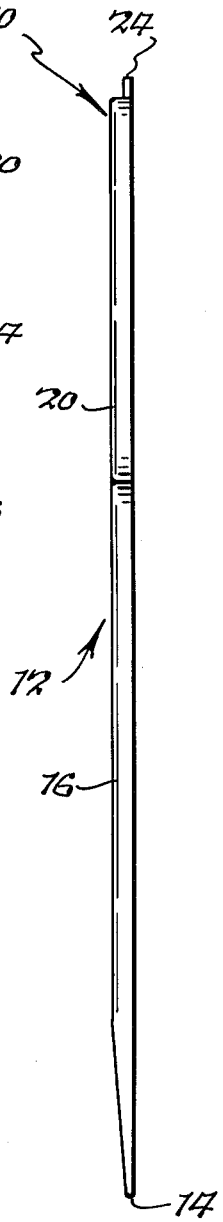
Fig. 3.
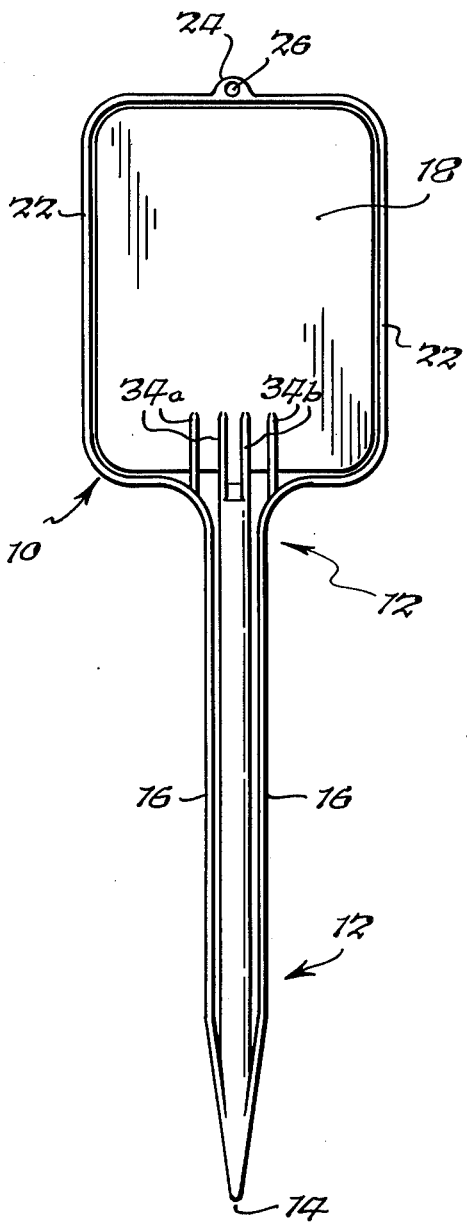
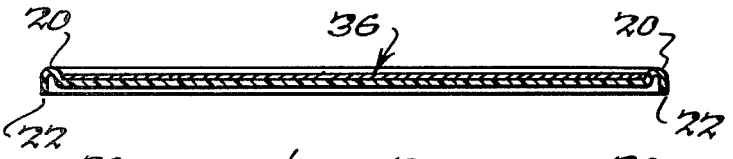
Fig. 4.
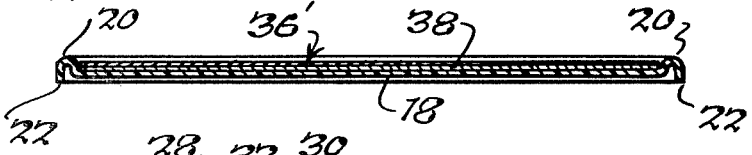
Fig. 5.
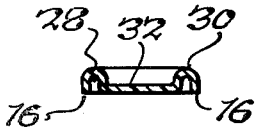
Fig. 6.

PLANT MARKER

BACKGROUND OF THE INVENTION

This invention relates to the horticultural arts, and more particularly to a new and improved plant marker.

Plant or garden markers have been proposed and patented which comprise a stake adapted to be driven in the ground adjacent a plant or group of plants which stake bears the name or other identification of the associated plants. It would be highly desirable to provide a plant or garden marker in the form of a separate stake element and a graphic identification member which is removably affixed or applied to a portion of the stake element. This would be advantageous both to consumers in terms of the number of devices they would need to purchase and to retailers in terms of the number of devices they would need to have in inventory.

SUMMARY OF THE INVENTION

It is, therefore, an object of this invention to provide a new and improved plant or garden marker.

It is a further object to provide such a marker comprising a stake element and a separate graphic identification member wherein different identification members can be removably applied to the stake element.

It is a further object of this invention to provide such a marker having sufficient strength and rigidity during installation and use.

It is a further object of this invention to provide such a marker which is convenient and easy for the user to assemble and install.

It is a further object of this invention to provide such a marker which is simple and economical to manufacture.

The present invention provides a plant or garden marker comprising a stake element of plastic or similar material having a formation at one end enabling the stake to be driven into the earth by the user and a smooth mounting surface portion at the opposite end for receiving an identification member. The marker further comprises a separate identification member bearing graphics, indicia or both removably applied or affixed to the stake mounting surface. The identification member can be in the form of a decal or in the form of a sheet element of paper, plastic or the like provided with a backing of pressure sensitive adhesive. The mounting surface on the stake element has a bead-like slightly protruding surface portion extending around the periphery thereof and defining or outlining the surface region which receives the identification member. The stake element includes a shank of relatively constant, narrow width between the mounting surface and the end formation, and the shank is provided with two generally parallel, longitudinally extending rib-like formations to enhance the strength and rigidity. Illustrations of various types of plants are provided on the identification member, one type of plant on each member, and the member is designed specifically to fit the particular marker. As a result, the consumer purchases stake elements and selects only the desired identification members separately according to the various varieties of plants he plans to grow. The retailer only needs to acquire the stake elements in bulk and stock the identification members in accordance with demand for the various types of plants.

The foregoing and additional advantages and characterizing features of the present invention will become apparent upon a reading of the ensuing detailed description together with the included drawing wherein:

BRIEF DESCRIPTION OF THE DRAWING FIGURES

FIG. 1 is a front elevational view of a plant marker according to the present invention;

FIG. 2 is a side elevational view of the plant marker of FIG. 1;

FIG. 3 is a rear elevational view of the plant marker of FIG. 1;

FIG. 4 is a sectional view taken about on line 4—4 of FIG. 1;

FIG. 5 is a sectional view similar to FIG. 4 showing an alternative form of identification member; and FIG. 6 is a sectional view with parts removed taken about on line 6—6 of FIG. 1.

DETAILED DESCRIPTION OF THE ILLUSTRATED EMBODIMENTS

Referring now to FIGS. 1-3, the plant or garden marker according to the present invention is generally designated 10 and includes a stake element 12 formed of suitable material, preferably plastic, provided with a formation, in the present instance a sharp pointed tip 14, at one end which enables the stake element to be pushed or driven part way into the earth, normally by hand. In the plant marker shown, the stake element 12 includes a shank portion 16 of relatively narrow and constant width extending from the sharp pointed formation 14 toward the other end of the stake element. The stake element 12 is provided with an enlarged formation at the other end thereof in the form of a smooth mounting portion 18. Portion 18 is of generally rectangular outline with the four corners thereof being curved. In the plant marker shown, the longer sides of the generally rectangular portion are disposed generally parallel to the longitudinal axis of shank 16. Other outlines or peripheral shapes can, of course, be employed. The mounting portion 18 preferably is in the form of a relatively thin sheet having oppositely directed planar surfaces extending over along the entire mounting surface 18. The stake element is formed to include a rib-like or bead-like slightly protruding surface portion 20 extending around the entire mounting portion 18. In particular, the rib 20 protrudes out with respect to one of the planar surfaces of mounting portion 18. The rib 20 is of relatively narrow width and of generally constant shape circumscribing the entire mounting surface 18. As shown in FIG. 4, the rib includes a substantially right angle corner immediately adjacent the planar surface of mounting portion 18, a central part extending outwardly from the corner and having a portion thereof disposed in a plane generally parallel to the plane of the surface of mounting portion 18, and an outer portion curved away from the central portion and in a direction toward the plane of the opposite surface of mounting portion 18. The rib 20 terminates in an edge 22 which is disposed in a plane parallel to the plane of surface 18 and spaced a small distance outwardly thereof. The edge 22 extends around the entire upper mounting portion 18 of the stake element. The rib 20 can be provided with an enlargement 24 at the end of stake element 12 directly opposite formation 14, i.e. at the top of the plant marker, which enlargment 24 can be provided with a hole or aperture 26 for hanging the marker 10 during storage.

The shank portion 16 preferably is formed to be of a cross section including two generally U-shaped formations 28 and 30 as shown in FIGS. 1 and 6 separated by a planar central web 32. The formations 28, 30 extend longitudinally along shank portion 16, preferably along the entire length thereof, and serve as strengthening ribs. The ribs 28, 30 are generally parallel and terminate in edges disposed in a plane parallel to the plane of central web 32.

The stake element 12 preferably is molded from plastic in a single forming or pressing operation. As a result, the strengthening rib formations 28, 30 preferably blend into or meet the marginal rib formation 20 which surrounds or outlines the mounting portion 18. The central web portion 32 is coplanar with the outer terminating edges of the ribs 28, 30 of shank 16 and these edges, in turn, are integral or continuous with the outer edge 22 around the mounting portion 18. The plant marker shown also includes first and second pairs of strengthening ribs 34*a* and 34*b*, respectively, on the surface of mounting portion 18 adjacent edge 22. The pair of ribs 34*a* are generally parallel and extend from the upper lefthand part of shank 16 a short distance along mounting portion 18. Similarly, the pair of ribs 34*b* are generally parallel and extend from the upper righthand portion of shank 16 a short distance along portion 18.

The plant marker 10 of the present invention further comprises an identification member 36 which is removably affixed or applied to the surface of the mounting portion 18. The member 36 is provided, for example, with a graphic illustration or drawing of a particular variety of plant. It may or may not have a word identification in addition to or in place of the graphic information. The member 36 is in the form of a thin sheet of suitable material and is of a size and has a peripheral outline such that it fits within the defining rib 20 which surrounds the mounting portion 18. The member 36 is affixed or applied to the planar surface of mounting portion 18 from which the rib 20 extends. The outer peripheral edge of member 36 is immediately adjacent or abutting the right-angle corner of rib 20. As shown in FIG. 4, for example, the identification member 36 can be in the form of a decal which is a single sheet which is applied to the mounting surface in a known manner. Alternatively, the identification member can comprise a thin sheet element 36' of plastic, paper or the like which is provided with a backing 38 of pressure sensitive adhesive material for holding or affixing it to the surface of mounting portion 18. In either event, the nature of the identification member 36 is such that it is fixedly applied or mounted to the surface of mounting portion 18 in the foregoing manner. Furthermore, the nature of member 36 is such that it can be removed from the mounting portion 18 thereby enabling a new and/or different identification member to be applied to the same stake element. Therefore, the stake element advantageously can be reused for a long time including many growing seasons.

The plant marker or identifier 10 of the present invention is used in the following manner. The user selects a desired identification member 18 bearing the identification of a particular plant of interest and then applies the graphic member 18 to the empty surface of mounting portion 18 within rib 20 of the stake element 12. Generally a user will have a group of identification members from which he will select desired ones from time to time as he plants different varieties of seeds and plants. The identifying member 36 is applied or mounted to the surface of mounting portion 18 in the usual manner for decals or, in case of the form shown in FIG. 5, a backing sheet is peeled away to expose the pressure sensitive adhesive material 38 whereupon the sheet element 36' is applied to the surface of mounting portion 18. The rib portion 20 serves to guide placement of the identification member onto the surface of mounting portion 18. The size and peripheral outline of the identification member 36 is substantially coincident with the inner edge or surface of the rib formation 20.

Thus, the consumer advantageously can purchase his desired number of stake elements 12 and separately purchase the identification members 36 according to the various varieties of vegetables, flowers or other plants he intends to grow. The combination advantageously enables the retailer to acquire the stake elements in bulk and to stock the identification members only in accordance with the consumer demand for various plants.

The shape of the cross section of the shank portion 16 provides strength and rigidity when the stake is driven into the ground and also during use when the marker is exposed to wind and the like. The rib formation 20 also contributes to strength and rigidity in this regard. The completed plant marker comprising stake element 12 and identification member 36 affixed thereto is then grasped by hand and simply driven or pushed into the ground adjacent the seeds, plants or groups thereof which the grower wishes to identify. Advantageously the same stake element can be reused to identify other seeds and plants during the same or subsequent growing seasons simply by removing the decal or pressure sensitive element 36 or 36', respectively, and substituting a new identification member.

It is therefore apparent that the present invention accomplishes its intended objects. While several embodiments of the present invention have been described in detail, this is for purposes of illustration, not limitation.

I claim:

1. A plant marker comprising:

(a) a one-piece stake element having a tip formation at one end thereof enabling said element to be driven into the earth and a mounting portion at the opposite end of the said stake element, said mounting portion including a smooth continuous mounting surface and a formation integral with said mounting surface extending around the periphery of said mounting surface and protruding from said mounting surface, the junction of said protruding formation and said mounting surface serving to outline said mounting surface;

(b) a sheet member having opposite faces joined by a peripheral edge, said sheet member bearing visible plant identification information on one face thereof, the opposite face thereof adapted to be applied to said mounting surface, and the area of said sheet member defined within said peripheral edge being of such size that said peripheral edge is within said junction of said protruding formation and said mounting surface and within said formation to guide placement of said sheet member on said mounting surface; and (e) means on said opposite face of said sheet member for adhering said sheet member to said mounting surface in a manner such that said sheet member can be removed subsequently from said surface to permit application of a new sheet member to said mounting surface.

2. A plant marker according to claim 1, wherein said stake element includes a shank of relatively narrow and relatively constant width between said tip formation and said mounting portion.

3. A plant marker according to claim 2, wherein the cross section of said shank includes two generally U-shaped portions joined by an intermediate portion.

4. A plant marker according to claim 1 wherein said mounting surface is planar.

5. A plant marker according to claim 1 wherein said formation outlining said mounting surface is rib-shaped.

6. A plant marker according to claim 1, wherein said sheet member comprises a decal.

7. A plant marker according to claim 1, wherein said means on said opposite face of said sheet member comprises pressure sensitive adhesive.

8. A plant marker according to claim 1, wherein each sheet member bears a graphic illustration of a particular variety of plant.

9. A plant marker according to claim 1, wherein said tip formation is a relatively sharp point.

10. A plant marker according to claim 1, wherein said stake element is formed of plastic.

* * * * *